United States Patent [19]

Fujimori

[11] Patent Number: 4,766,863

[45] Date of Patent: Aug. 30, 1988

[54] APPARATUS FOR CONTROLLING THE IDLING OPERATION OF AN INTERNAL COMBUSTION ENGINE

[75] Inventor: Kyoichi Fujimori, Higashimatsuyama, Japan

[73] Assignee: Diesel Kiki Co., Ltd., Tokyo, Japan

[21] Appl. No.: 928,088

[22] Filed: Nov. 7, 1986

[30] Foreign Application Priority Data

Nov. 14, 1985 [JP] Japan ..... 60-253726

[51] Int. Cl.[4] ..... F02M 39/00

[52] U.S. Cl. ..... 123/357; 123/419; 123/436; 123/500

[58] Field of Search ..... 123/357, 358, 359, 500, 123/501, 419, 436

[56] References Cited

U.S. PATENT DOCUMENTS

| | | | |
|---|---|---|---|
| 4,357,662 | 11/1982 | Schira | 123/419 |
| 4,395,668 | 3/1983 | Leung | 123/419 |
| 4,489,690 | 12/1984 | Burkel | 123/419 |
| 4,572,130 | 2/1986 | Tsukamoto | 123/357 |
| 4,589,391 | 5/1986 | Sieber | 123/357 |
| 4,594,979 | 6/1986 | Yasuhara | 123/357 |
| 4,616,617 | 10/1986 | Geiger | 123/436 |
| 4,619,234 | 10/1986 | Okamoto | 123/357 |
| 4,640,241 | 2/1987 | Matsunaga | 123/357 |
| 4,667,634 | 5/1987 | Matsumura | 123/357 |
| 4,671,236 | 6/1987 | Matsumura | 123/357 |

FOREIGN PATENT DOCUMENTS 59-82534 5/1984 Japan .

*Primary Examiner*—Carl Stuart Miller

*Attorney, Agent, or Firm*—Pollock, Vande Sande & Priddy

[57] ABSTRACT

In an individual cylinder control apparatus having a closed-loop control system for controlling an average speed of an internal combustion engine, the operation timing of the engine is detected and a timing signal for each cylinder, showing a predetermined measurement period determined to include at least that part of the period during which torque is produced due to fuel combustion in the cylinder concerned during which no influence arises because of torque produced in cylinders other than the cylinder concerned, is output in response to the result of the detection. In response to the timing signal, difference data representing the difference between the output from each cylinder and that from a predetermined reference cylinder among the cylinders is calculated. Individual cylinder control data related to the supply of fuel necessary for reducing the difference to zero is produced in response to the difference data, and the individual cylinder data is output and provided to the closed-loop control system at a predetermined timing before the next fuel regulating process for the individual cylinders, whereby the fuel quantity for each cylinder is regulated so as to make the respective output of the cylinders the same.

10 Claims, 6 Drawing Sheets

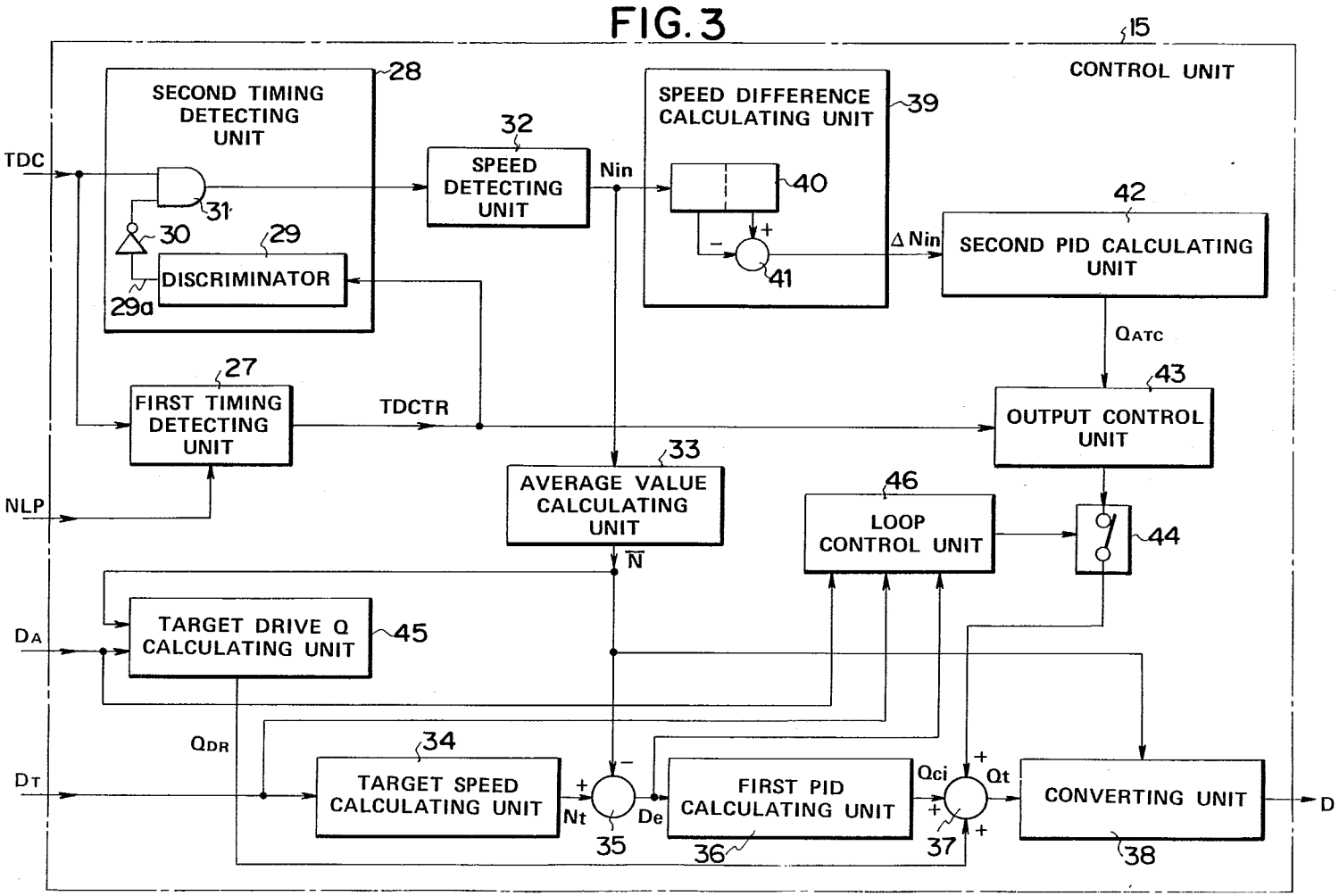
FIG. 3
15
CONTROL UNIT
SECOND TIMING DETECTING UNIT
28
31
30
29
DISCRIMINATOR
29a
SPEED DETECTING UNIT
32
Nin
SPEED DIFFERENCE CALCULATING UNIT
39
40
41
Δ Nin
SECOND PID CALCULATING UNIT
42
QATC
OUTPUT CONTROL UNIT
43
44
FIRST TIMING DETECTING UNIT
27
TDCTR
AVERAGE VALUE CALCULATING UNIT
33
N̄
LOOP CONTROL UNIT
46
TARGET DRIVE Q CALCULATING UNIT
45
QDR
TARGET SPEED CALCULATING UNIT
34
Nt
De
35
FIRST PID CALCULATING UNIT
36
Qci
Qt
37
CONVERTING UNIT
38
D
TDC
NLP
DA
DT

APPARATUS FOR CONTROLLING THE IDLING OPERATION OF AN INTERNAL COMBUSTION ENGINE

BACKGROUND OF THE INVENTION

The present invention relates to an idling operation control apparatus for an internal combustion engine, more particularly to an idling operation control apparatus for an internal combustion engine adapted to regulate the fuel to be supplied to each cylinder so as to minimize dispersion in the output among the cylinders of a multiple cylinder internal combustion engine, whereby a stable idling operation is realized.

In the conventional control system for controlling the amount of fuel injected from a fuel injection pump into a multiple cylinder internal combustion engine, the fuel injection amount for all cylinders is uniformly controlled in common. Accordingly, uniform output cannot be obtained from the cylinders due to differences within the manufacturing tolerance of the internal combustion engine and/or the fuel injection pump and the like.

In particular, non-uniform output of the cylinders causes a conspicuous degradation in the stability of the internal combustion engine during the idling operation of the engine, and this in turn increases the amount of harmful components included in the exhaust gas. Furthermore, non-uniform output gives rise to engine vibration which in turn causes such disadvantages as increased noise.

In order to overcome the above disadvantages, there have been proposed various apparatuses for individually controlling the fuel to be injected into the respective cylinders of the internal combustion engine according to an individual cylinder control method. Japanese Patent Application Public Disclosure No. 82534/84 discloses an example of an apparatus of this type in which individual cylinder control is carried out on the basis of the result of a detection carried out for every combustion stroke in each cylinder, of the difference between the rotational speed at the time of the combustion of fuel supplied by injection to the multiple cylinder internal combustion engine and the rotational speed at the time when the instantaneous rotational speed of the crankshaft reaches the maximum value as a result of the above-mentioned combustion.

Although there is no problem when this type of method is applied to a 4-cylinder internal combustion engine as shown in the embodiment described in this Public Disclosure, disadvantages such as the following will result if it is applied to, for example, a 6-cylinder internal combustion engine.

In an engine in which combustion arises at a period of less than 180° CA (angle of the crankshaft) such as a 6-cylinder internal combustion engine, the output torque produced during the power stroke of the cylinder under consideration is influenced by the output torque of the cylinders whose power strokes are started at the end portion of the power stroke of the cylinder under consideration and/or terminated at the beginning portion thereof. Accordingly, it is impossible to accurately detect the output of a desired specific cylinder with the method according to the prior art. As a result, when individual cylinder control is carried out in a multi-cylinder internal combustion engine in which combustion occurs at a period of less than 180° CA according to the conventional method, the detection data is inaccurate, creating disadvantages such as an increase in the vibration produced by the internal combustion engine.

SUMMARY OF THE INVENTION

It is an object of the present invention to provide an improved apparatus for controlling the idling operation of an internal combustion engine.

It is another object of the present invention to provide an apparatus for controlling the idling operation of an internal combustion engine in which the control of fuel injection for each cylinder can be carried out well regardless of the number of cylinders of the internal combustion engine to be controlled.

According to the present invention, in an apparatus for controlling the idling operation of an internal combustion engine consisting of a closed-loop control system for controlling the amount of fuel to be supplied to a multi-cylinder internal combustion engine so as to maintain the average engine speed of the internal combustion engine at a desired target idling rotational speed, the apparatus comprises a first detecting means for detecting the operation timing of the internal combustion engine, a second detecting means responsive to the output from the first detecting means for producing a timing signal for each cylinder showing a predetermined measurement period determined to include at least that part of the period during which torque is produced due to fuel combustion in the cylinder concerned during which no influence arises because of torque produced in cylinders other than the cylinder concerned, a first calculating means responsive to the timing signal for calculating and producing a first data related to the output from each cylinder of the internal combustion engine, a second calculating means responsive to the first data for sequentially and repeatedly calculating and producing for every cylinder, a difference data corresponding to the difference between the output from each cylinder and the output from a predetermined reference cylinder among the cylinders, a third calculating means responsive to the difference data for calculating and producing an individual cylinder control data related to the supply of fuel necessary for reducing to zero the difference shown by the difference data, an output control means for outputting the individual cylinder control data at a predetermined timing before the next fuel regulating process for the individual cylinders on the basis of the result of the detection in the first detecting means and an adding unit for supplying the individual cylinder control data to the closed-loop control system.

With this constitution, a feedback control loop for controlling the fuel quantity supplied into the respective cylinders so as to make the outputs from the cylinders of the internal combustion engine equal, is provided in a feedback control loop for controlling the engine speed in such a way that the average speed of the internal combustion engine becomes equal to the desired idling rotational speed. The second detecting means determines the measurement period for each of the cylinders and a first data relating to the output from the individual cylinders, for example, an engine speed data, is obtained by the first calculating means during the measurement period. Since the above-mentioned measurement period is set so as to include, of the period during which torque is produced due to fuel combustion in the cylinder concerned, at least that part during which no influence arises because of torque produced in cylinders other than the cylinder concerned, the value of the output from the individual cylinders shown by the first data is highly accurate. An individual cylinder control data for making the output from each cylinder of the internal combustion engine equal is output from the third calculating means on the basis of the first data obtained as mentioned above. The control of the average idling rotational speed carried out by the closed-loop control system is corrected by the individual cylinder control data for each of the cylinders. As a result, the amount of fuel injected to each cylinder is determined so as to make the output from each cylinder of the internal combustion engine substantially the same.

The invention will be better understood and other objects and advantages thereof will be more apparent from the following detailed description of preferred embodiments with reference to the accompanying drawings.

BRIEF DESCRIPTION OF THE DRAWINGS

FIG. 3 is a block diagram for explaining the control function of the microcomputer shown in FIG. 1;

DESCRIPTION OF THE PREFERRED EMBODIMENTS

Figure 1:
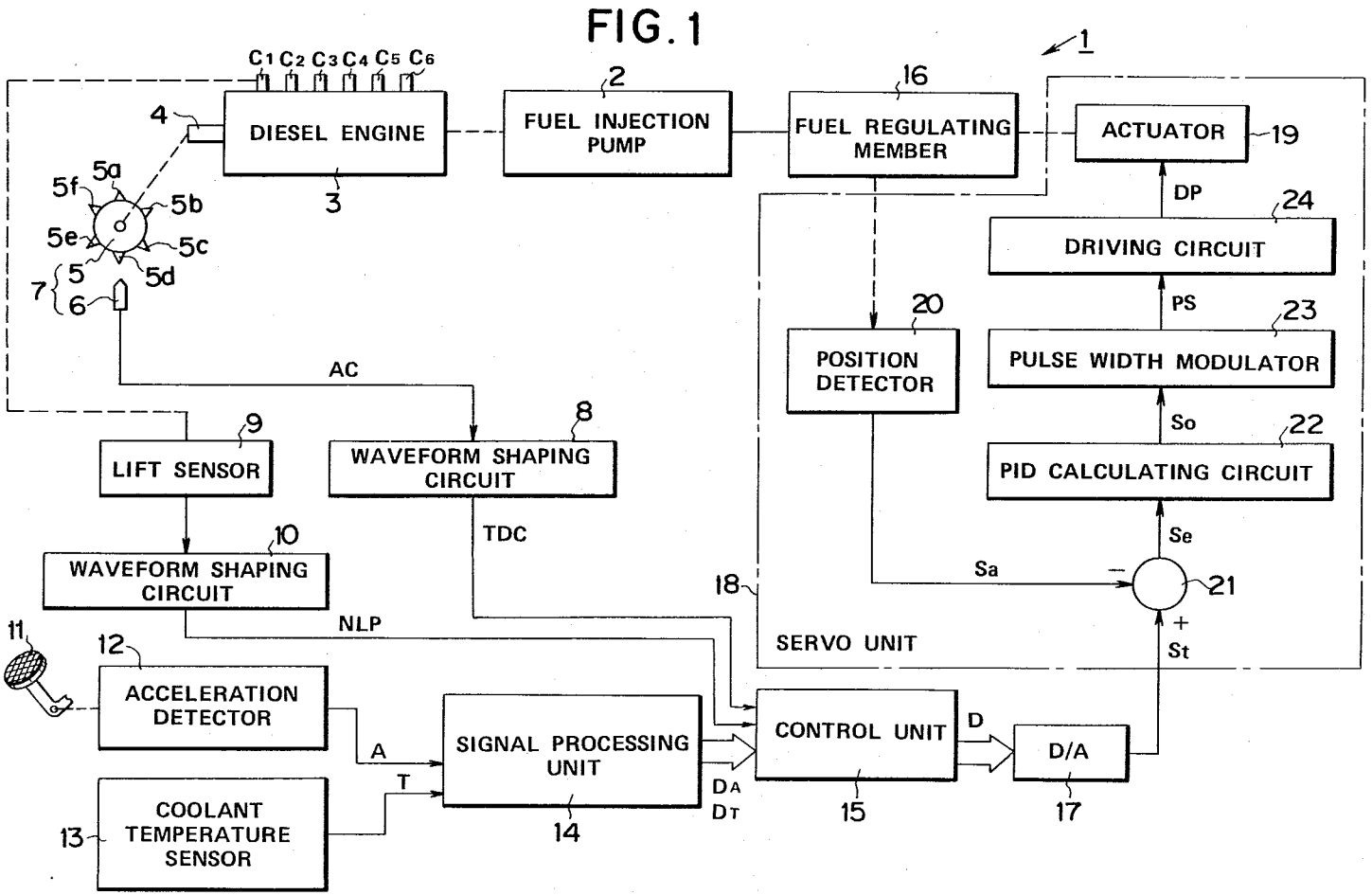
FIG. 1 is a block diagram of an embodiment of an idling operation control apparatus according to the present invention.

FIG. 1 is a block diagram of an embodiment of an idling operation control apparatus for an internal combustion engine according to the present invention. An idling operation control apparatus 1 serves to control the idling engine speed of a diesel engine 3 to which fuel is supplied from a fuel injection pump 2.

A well-known rotation sensor 7 consisting of a pulser 5 and an electromagnetic pick-up coil 6 is provided on a crankshaft 4 of the diesel engine 3. In this embodiment, the diesel engine 3 is of the 4-cycle, 6-cylinder type and has six cylinders $C_1$ to $C_6$.

FIGS. 2A to 2F show timecharts representing the fuel combustion timing and the magnitude of the output torque produced as a result of the combustion of fuel in the cylinders $C_1$ to $C_6$, respectively. The horizontal axis represents the crankshaft angle (°CA) where the fuel combustion start timing in the cylinder $C_1$ is zero degree. Since the diesel engine 3 in this embodiment is a 4-cycle 6-cylinder type, the next fuel combustion in cylinder $C_1$ starts at 720 (°CA) and, in general, it follows that fuel combustion starts in the cylinders at intervals of 120 (°CA), i.e., there is an interval of 120 (°CA) between combustion in one cylinder and that in the next. In this embodiment, the combustion of fuel is carried out in the sequence $C_1$, $C_2$, $C_3$, $C_4$, $C_5$ and $C_6$. In whichever cylinder, the output torque rises up to 60 (°CA) from the time of the start of fuel combustion while the output torque decreases after 60 (°CA). The output torque becomes zero at a time when 180 (°CA) has been reached where the combustion stroke in that cylinder has been completed. FIGS. 2A to 2F diagramatically illustrate the condition of the change in the output torque $TQ_1$ to $TQ_6$ from the cylinders $C_1$ to $C_6$, respectively. Moreover, the fuel combustion start timing of the individual cylinders may not necessarily coincide precisely with the top dead center timing of the corresponding piston of the cylinder. However, for convenience of description, the combustion start timing will be assumed to coincide with the top dead center timing.

Figures 2A, 2B, 2C, 2D, 2E, 2F, 2G, 2H:
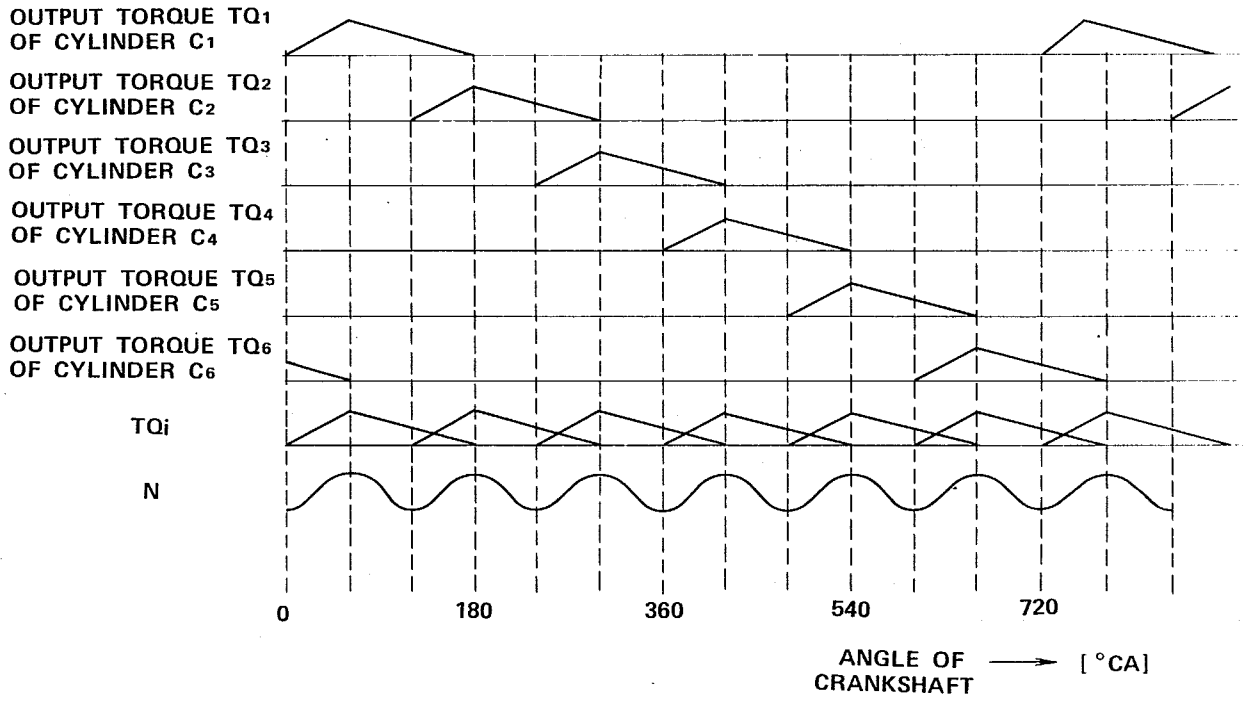
FIGS. 2A to 2H are timecharts for explaining the operating condition of the diesel engine 3 shown in FIG. 1.

As a result of the output torque of the respective cylinders occurring as shown in FIGS. 2A to 2F, the instantaneous value $TQ_i$ of the torque output from the crankshaft 4 will be as shown in FIG. 2G and the instantaneous rotational speed N of the crankshaft 4 changes at a period of 120 (°CA) as shown in FIG. 2H.

Referring back to FIG. 1, in order to detect the timing at which the angular position of the crankshaft 4 of the diesel engine 3 reaches the predetermined reference angular positions by the rotation sensor 7, a set of cogs, $5_a$ to $5_f$ is formed around the periphery of pulser 5, separated from each other by 60°. The pulser 5 is secured to the crankshaft 4 in such a way that one of the cogs from $5_a$ to $5_f$ faces the electromagnetic pick-up coil 6 at each instant the crankshaft 4 reaches one of the predetermined angular positions. An output signal AC from the rotation sensor 7 is input to a waveform shaping circuit 8, from which is output a top dead center pulse signal TDC consisting of top dead center pulses indicating the top dead center timing of the pistons of the respective cylinders.

Figures 4A, 4B, 4C, 4D, 4E, 4F, 4G, 4H, 4I, 4J, 4K:
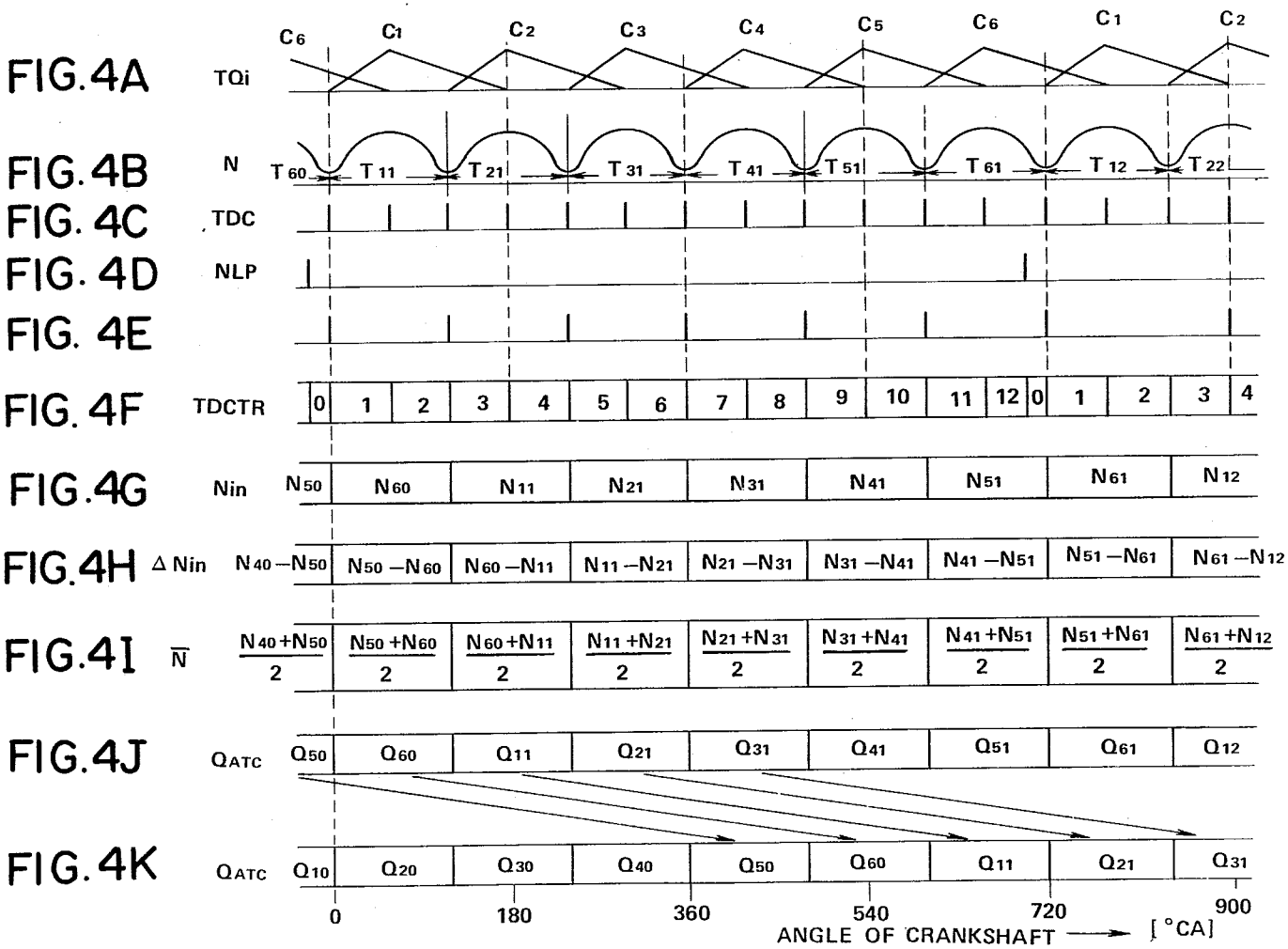
FIGS. 4A to 4K are timecharts for explaining the operation of the apparatus shown in FIG. 1 and FIG. 3.

FIGS. 4A and 4B show the instantaneous value $TQ_i$ of the torque output from the crankshaft 4 of the diesel engine 3 and the instantaneous rotational speed N of the crankshaft 4, respectively, whereas FIG. 4C shows a waveform of the top dead center pulse signal TDC. Among the pulses constituting the top dead center pulse signal TDC, those corresponding to the minimum points of the instantaneous rotational speed N represent the start timing of the fuel combustion in the respective cylinders.

In order to detect what sort of timing in which cylinder is represented by each pulse of the top dead center pulse signal TDC, a lift sensor 9 for detecting the needle lift timing of a fuel injection valve (not shown) is provided on the cylinder $C_1$. The output pulse generated from the lift sensor 9 is shaped into a waveform by a corresponding waveform shaping circuit 10, resulting in the output of a lift pulse signal NLP. The lift pulse signal NLP is output just before the beginning of the fuel combustion in cylinder $C_1$ at intervals of 720 (°CA) as shown in FIG. 4D. The detection of the operation timing of the diesel engine 3 is carried out in response to the lift pulse signal NLP and the top dead center pulse signal TDC as described below.

The apparatus 1 further comprises an acceleration detector 12 connected to an accelerator pedal 11 for detecting the amount of operation of the accelerator pedal 11 and producing an acceleration signal A indicating the amount of operation of the accelerator pedal 11. Numeral 13 denotes a coolant temperature sensor for detecting the coolant temperature of the diesel engine 3 and a coolant temperature signal T indicating the coolant temperature is produced from the coolant temperature sensor 13.

The acceleration signal A and the coolant temperature signal T are input to a signal processing unit 14 wherein the acceleration signal A and the coolant temperature signal T are changed into corresponding data $D_A$, $D_T$ in digital form and input to a control unit 15 to which the top dead center pulse signal TDC and the lift pulse signal NLP are input. The control unit 15 is provided for calculating the amount of fuel injection for each of the cylinders necessary for obtaining a desired idling rotational speed. The operation for regulating the amount of fuel injected is carried out by a fuel regulating member 16 of the fuel injection pump 2, and the result of the calculation showing the desired injected amount of each cylinder calculated in the control unit 15 is output as control data D representing the regulating position of the fuel regulating member 16. The control data D is converted into a position control signal $S_t$ corresponding to the control data D by a digital-analog (D/A) converter 17, and the position control signal $S_t$ is input into a servo unit 18 for controlling the position of the fuel regulating member 16.

The servo unit 18 has an actuator 19 connected to the fuel regulating member 16 and the feedback control of the position of the fuel regulating member 16 is carried out by the actuator 19 in response to the position control signal $S_t$. The servo unit 18 is also provided with a position detector 20 for producing an actual position signal indicating the actual regulated position of the fuel regulating member 16 at each instant. An actual position signal $S_a$ from the position detector 20 is added to the position control signal $S_t$ in an adder 21 with the polarity as shown in FIG. 1. Consequently, the adder 21 outputs an error signal $S_e$ indicating the difference between the target position of the fuel regulating member 16 necessary for obtaining the predetermined amount of fuel calculated in the control unit 15 and the actual position thereof. The error signal $S_e$ is input to a PID calculating circuit 22 wherein a signal processing for PID control is carried out for the error signal $S_e$, and the output signal $S_o$ from the PID calculating circuit 22 is input to a pulse width modulator 23. The pulse width modulator 23 outputs a pulse signal PS whose duty ratio changes in correspondence to the level of the output signal $S_o$. The pulse signal PS is amplified to a level sufficient for driving the actuator 19 by a driving circuit 24 and the actuator 19 is driven by a driving pulse DP obtained as shown in the above.

The actuator 19 is operated by the driving pulse DP so as to adjust the position of the fuel regulating member 16 in the direction towards which the error signal $S_e$ is reduced to zero. As a result, a feedback control is carried out in such a way that the position of the fuel regulating member 16 is set in a suitable position indicated by the position control signal $S_t$.

The following is a description with reference to FIG. 3 of the detailed constitution of the control unit 15 responsive to the various input signals mentioned above for calculating and outputting the control data D.

In order to detect the operation timing of the diesel engine 3, there is provided a first timing detecting unit 27 which is a counter operating in response to the top dead center pulse signal TDC and the lift pulse signal NLP. The first timing detecting unit 27 is reset by the lift pulse signal NLP and has a counting function which increments at every input of each pulse of the top dead center pulse signal TDC. The result of the counting in the first detecting unit 27 is obtained as a count signal TDCTR. Consequently, the counted value of the count signal TDCTR changes as shown in FIG. 4F and the time period during which the instantaneous engine speed N changes from a minimum point to a maximum point and the time period during which the instantaneous engine speed N changes from a maximum point to a minimum point can be discriminated by whether the value of the count signal TDCTR is an even number or an odd number (see FIG. 4B).

The count signal TDCTR is supplied to a second timing detecting unit 28 for producing a timing signal for each cylinder determining a predetermined measurement period which includes at least that part of the period during which torque is produced due to fuel combustion in the cylinder concerned during which no influence arises because of torque produced in cylinders other than the cylinder concerned.

The second timing detecting unit 28 has a discriminator 29 responsive to the count signal TDCTR for discriminating whether the value of the count signal TDCTR is an even number or an odd number, and the discriminator 29 produces a high level signal on its output line $29_a$ when the value of the count signal TDCTR is an odd number. The output line $29_a$ is connected through an inverter 30 with one input terminal of an AND-gate 31 having another input terminal to which the top dead center pulse signal TDC is applied.

Therefore, the AND-gate 31 is opened only when the value of the count signal TDCTR is even or zero, so that only the pulses of the top dead center pulse signal TDC corresponding to the minimum points of the instantaneous engine speed N are allowed to pass through the AND-gate 31 and the pulses obtained through the AND-gate 31 are derived as the timing signal from the second timing detecting unit 28.

The timing signal TS is input to a speed detecting unit 32, wherein the times $T_{11}$, $T_{21}$, $T_{31}$ . . . from the time at which the instantaneous engine speed N reached a minimum state to the time at which it reaches its next minimum state are measured based on the timing signal TS (see FIGS. 4B and 4E). The times $T_{11}$, $T_{21}$, $T_{31}$ . . . are related to the engine speed, that is, the output from the respective cylinders. The time period set for measuring the engine speed in the above-mentioned manner is determined on the basis of the state of TDCTR in such a way that it includes, of the period during which torque is produced due to fuel combustion in the cylinder concerned, at least that part during which no influence arises because of torque produced in cylinders other than the cylinder concerned.

In other words, when the time to be measured is $T_{11}$, for example, the measurement period $\theta$ set for measuring this time $T_{11}$ is for carrying out the measurement concerning the output from the cylinder $C_1$ and, of the total period (0 (°CA) to 180 (°CA)) during which torque is produced due to fuel combustion in cylinder $C_1$, includes only all of the period (60 (°CA) to 120 (°CA)) not influenced by torque produced in cylinders $C_6$ and $C_2$ and a period (0 (°CA) to 60 (°CA)) slightly influenced by the output from cylinder $C_6$. It is likewise the case with the setting of the time period for measuring other times $T_{21}$, $T_{31}$, . . . in this way, when the measurement periods are set so as to include all of the period during which there is no influence from the torque arising in other cylinders, but not to include all of the period during which there is influence from the torque arising in other cylinders, it is possible to obtain a time measurement which correponds almost exactly to the output from the specific cylinder under consideration and also to obtain accurate information concerning the output from each of the cylinders.

Times $T_{11}$, $T_{21}$, $T_{31}$, . . . obtained as forementioned represent the time required for the crankshaft 4 to rotate 120 (°CA). An instantaneous speed data representing the instantaneous rotational engine speed corresponding to the output from each cylinder $C_i$ is calculated in the speed detecting unit 32 by the use of the times $T_{11}$, $T_{21}$, $T_{31}$, . . . the instantaneous speed data representing the instantaneous rotational engine speed for cylinder $C_i$ will be generally represented here in accordance with the sequence in which they were detected in the speed detecting unit 32 as $N_{in}$ (n=0, 1, 2, . . .).

Accordingly, the contents of the instantaneous speed data $N_{in}$ output from the speed detecting unit 32 will be as shown in FIG. 4G.

The instantaneous speed data $N_{in}$ is input to an average value calculating unit 33 where the average speed of the diesel engine 3 is calculated, and an average speed data $\overline{N}$ indicating the average engine speed is produced. In this case, the average speed data $\overline{N}$ is calculated on the basis of two serial instantaneous speed data from the speed detecting unit 32 (see FIG. 4I). Numeral 34 denotes a target speed calculating unit which calculates a target idling speed corresponding to the operating condition of the diesel engine 3 at each instant in response to the coolant temperature data $D_T$ and outputs a target speed data $N_t$ representing the result of that calculation. The average value calculating unit 33 outputs the average speed data $\overline{N}$ representing the average speed of the diesel engine and the target speed data $N_t$ and the average speed data $\overline{N}$ are added together in an adding unit 35 with the polarities as shown in FIG. 3. The result of this addition is derived as error data $D_e$, which is input to a first PID (Proportional, Integral and Differential) calculating unit 36 for performing data processing for PID control for error data $D_e$.

The result of the calculation performed in the first PID calculating unit 36 is derived as data $Q_{ci}$ with an injection amount dimension, which is applied through an adding unit 37 to a converting unit 38 to which the average speed data $\overline{N}$ is also input. Data supplied from the adding unit 37 is converted into control data D representing the target position of the fuel regulating member 16 which is necessary to reduce the content of the error data $D_e$ to zero.

As can be understood from the forementioned description, the apparatus 1 has a closed loop control system responsive to the average speed data $\overline{N}$ and the target speed data $N_t$ for controlling the average idling rotational speed of the diesel engine 3 so as to coincide with the desired target value.

Although, in this embodiment, the average speed data $\overline{N}$ is calculated on the basis of the instantaneous speed data $N_{in}$ from the speed detecting unit 32, the average speed data $\overline{N}$ may be obtained by any conventional device.

The apparatus 1 has another closed loop control system for individual cylinder control, by which the fuel supplied to the engine is regulated for each of the cylinders so as to make the instantaneous engine speeds for the respective cylinders equal. This closed control loop system comprises a speed difference calculating unit 39 which is responsive to the instantaneous speed data $N_{in}$ and sequentially and repeatedly calculates for every cylinder the difference between the instantaneous engine speed due to the output from each cylinder and that due to the output from a reference cylinder which is predetermined among the respective cylinders. In this embodiment, the instantaneous engine speed obtained immediately prior to the instantaneous engine speed for a specific cylinder under consideration is selected as the reference instantaneous speed for the specific cylinder. Thus, the difference value $N_{11}-N_{21}$, $N_{21}-N_{31}$, $N_{31}-N_{41}$, . . . are sequentially output from the speed difference calculating unit 39 as difference data $\Delta N_{in}$. In this embodiment, the speed difference calculating unit 39 has a shift register 40 and an adder 41. The shift register 40 receives the instantaneous speed data $N_{in}$ and stores only the last two instantaneous speed data in the series. The last two sequential data from the shift register 40 are input into the adder 41 in which these two data are added with the polarity shown in FIG. 3 to obtain the necessary difference data $\Delta N_{in}$ in sequence. The output timings and the contents of these difference data $\Delta N_{in}$ are shown in FIG. 4H.

The difference date $\Delta N_{in}$ is input to a second PID calculating unit 42 for performing a required process for PID control on the difference data $\Delta N_{in}$. Then, the second PID calculating unit 42 outputs individual cylinder fuel quantity data $Q_{ATC}$ representing the fuel quantity to be regulated for each cylinder in order to make the output from the respective cylinders the same and the individual cylinder fuel quantity data $Q_{ATC}$ is input to an output control unit 43. FIG. 4J shows the state in which the content of the individual cylinder fuel quantity data $Q_{ATC}$ is renewed every 120 (°CA).

The output control unit 43 serves to control the output timings of the individual cylinder fuel quantity data $Q_{ATC}$. These output timings are controlled, in accordance with the count signal TDCTR from the first timing detecting unit 27, as described in the following.

Assuming that the individual cylinder fuel quantity data $Q_{ATC}$ produced at any particular timing is obtained based upon the difference data $\Delta N_{in}$ relating to two of the cylinders $C_i$ and $C_{i+1}$, the individual cylinder fuel quantity data $Q_{ATC}$ is output before or during the subsequent fuel regulating stroke for cylinder $C_{i+1}$. In this case, the individual cylinder fuel quantity data $Q_{ATC}$ is output after 8 counted units of the count signal TDCTR. That is, the time slot for outputting the individual cylinder fuel quantity data $Q_{ATC}$ is shifted back in the output control unit 43 by 8 counted units of the count signal TDCTR.

The individual cylinder fuel quantity data $Q_{ATC}$ is provided through a switch 44 to the adding unit 37, and is added to data $Q_{ci}$ output from the first PID calculating unit 36 at that time, in the adding unit 37. The adding unit 37 is further input with a drive Q data $Q_{DR}$ from a target drive Q calculating unit 45. The target drive Q calculating unit 45 calculates a desired target drive fuel quantity corresponding to the condition of depression of the accelerator pedal 11, in response to the average speed data $\overline{N}$ and the acceleration data $D_A$, and outputs the data showing the result of the calculation as drive Q data $Q_{DR}$. The adding unit 37 adds together data $Q_{ATC}$, $Q_{ci}$, and $Q_{DR}$ and outputs data $Q_t$ representing the total sum.

As can be understood from the above-mentioned description, for example, the value $Q_{11}$ of the individual cylinder fuel quantity data $Q_{ATC}$ represents the amount of fuel to be regulated in order to reduce to zero the difference between the instantaneous engine speed for the cylinder $C_6$ and the instantaneous engine speed for the cylinder $C_1$, that is, between the output from the cylinder $C_6$ and the output from the cylinder $C_1$. The individual cylinder fuel quantity data $Q_{ATC}$ with value $Q_{11}$ is output during the period from (600 (°CA) to 720 (°CA)) which is in the following fuel pressurizing stroke in the cylinder $C_1$ and by which fuel injection in the next cylinder (cylinder $C_5$) is not influenced (refer to FIGS. 4J and 4K). In the same manner as described above, the operation for reducing the difference in output between the cylinders is sequentially carried out to reduce to zero the difference in output between cylinders $C_1$ and $C_2$, the difference between cylinders $C_2$ and $C_3$. the difference between cylinders $C_3$ and $C_4$, the difference between cylinders $C_4$ and $C_5$, and the difference between cylinders $C_5$ and $C_6$. In this way, control for regulating the fuel quantity is performed for each cylinder so as to make the output from the cylinders identical.

Furthermore, the switch 44, provided on the output side of the output control unit 43, is controlled so as to be set to the ON or OFF state by a loop control unit 46. The switch 44 is closed to perform individual cylinder control, only when the loop control unit 46 detects that predetermined conditions have been satisfied which indicate that individual cylinder control can be performed in a stable manner. On the other hand, if these predetermined conditions are not met, then, the switch 44 is opened to inhibit individual cylinder control from being carried out, thereby preventing instability of the idling operation resulting from individual cylinder control.

More specifically, for carrying out the control of the angular speed by the forementioned individual cylinder control, it is desirable that the idling rotational speed be in a stable condition in which the engine speed is within a predetermined speed range including a desired target value. This is because a good individual cylinder control operation is efficiently performed in the manner described above only if the change in the instantaneous engine speed resulting from deviation from design standards of the fuel injection system and the internal combustion engine occurs in a regular, periodic fashion. Consequently, if individual cylinder control is carried out when an accelerating/decelerating operation is being carried out, or when some abnormality has arisen in the control system, the instability of the idling operation would become greater.

Therefore, in this embodiment, the switch 44 is closed to form the control loop for individual cylinder control only when the following conditions are all satisfied. Firstly, the coolant temperature must be greater than a predetermined value $T_r$. Secondly, the absolute value of the difference between the target idling engine speed and the actual idling engine speed must be maintained under a predetermined value $K_1$ for more than the predetermined time. Thirdly, the amount of depression $A_p$ of the accelerator pedal must be below a predetermined value $A_1$.

On the other hand, if a single one of the above conditions is not satisfied, the switch 44 will be opened and individual cylinder control will be terminated.

Moreover, since the condition of the control operation changes according to whether individual cylinder control is performed, it is possible to constitute the apparatus 1 so that the PID constant in the first PID calculating unit 36 and the second PID calculating circuit 42 is changed in response to the open/closed state of the switch 44, thus enabling a much greater stabilization of the operation.

According to the above-mentioned constitution, control operations for transition-type changes such as of the undershoot of the engine speed and for controlling the idling engine speed so as to make it approach substantially the target value, are performed by the closed loop control system which is responsive to the average engine speed of the diesel engine 3 and the actual position of the fuel regulating member 16. Thus, individual cylinder control is carried out in the resulting stable condition of the idling engine speed obtained by the average idling engine speed control system so as to eliminate the differences among the outputs of the respective cylinders. Furthermore, the data representing the respective outputs of the cylinders, which are necessary for performing individual cylinder control, are obtained on the basis of the rotation of the crankshaft 4 within a predetermined measurement period which is determined so as to include at least that part of the period during which torque is produced due to fuel combustion in the cylinder concerned during which no influence arises because of torque produced in cylinders other than the cylinder concerned. Therefore, it is possible to obtain data related to the output from a particular cylinder under consideration while suppressing the influence from the output of the other cylinders to the minimum. As a result, individual cylinder control of the idling operation can be carried out with stability.

The same function as that of the control unit 15 described above can be realized by executing an appropriate control program in a microcomputer, and an apparatus with this type of constitution comes within the scope of the present invention.

Figure 5:
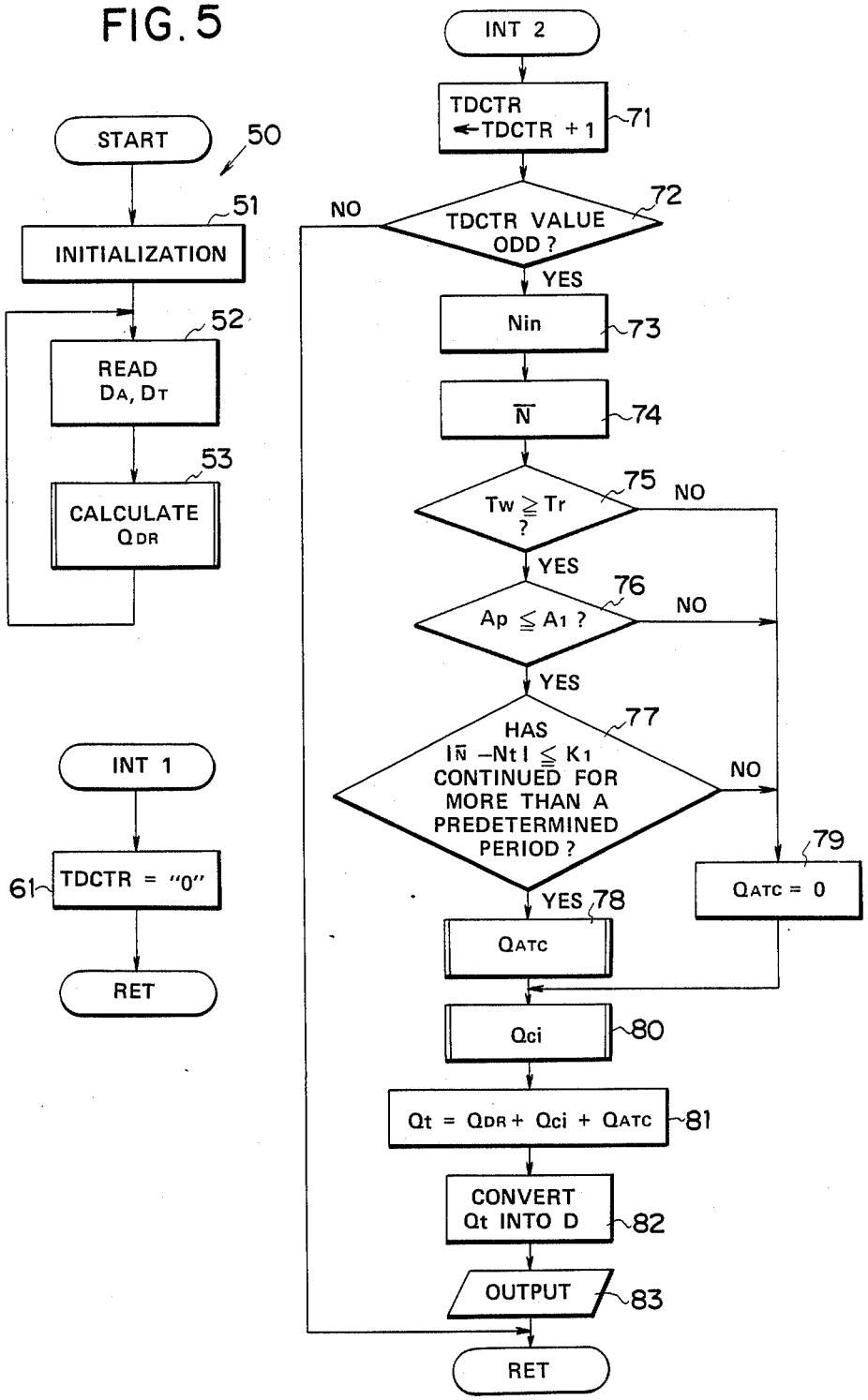
FIG. 5 is a flowchart showing a control program stored in a microcomputer for realizing the control function shown in FIG. 3.

FIG. 5 is a flowchart showing a control program to be executed in a microcomputer for realizing a similar control function to that of the control unit 15 shown in FIG. 1. This control program will be explained on the basis of this flowchart in the following. This control program comprises a main control program 50, and two interrupt programs INT 1 and INT 2. The main control program 50 is for calculating the drive Q data $Q_{DR}$, having a step 51 in which operation is initialized after which the operation moves to step 52 where acceleration data $D_A$ and the coolant temperature data $D_T$ are read in. The procedure then moves to step 53 wherein the drive Q data $Q_{DR}$ is calculated on the basis of the acceleration data $D_A$ and the average speed data $\overline{N}$ obtained in the interrupt program INT 2 to be described later.

The interrupt program INT 1 is executed every time a lift pulse signal NLP is generated. When the execution of the interrupt program INT 1 starts, the variable TDCTR representing the counted value of a counter formed by software, is reset in step 61 and the procedure returns to the main program 50.

The interrupt program INT 2 is executed every time one of the pulses of the top dead center pulse signal TDC is produced. When the execution of the interrupt program INT 2 starts, the operation firstly goes to step 71 where the value of TDCTR is incremented by one and then to step 72 wherein the discrimination is made as to whether the value of TDCTR is an odd number or not. When the value of TDCTR is an odd number, the result of the discrimination in step 72 becomes YES and the procedure moves on to step 73 where data $N_{in}$ is calculated. As can be seen from FIG. 4, the data $N_{in}$ calculated at this time is data for a cylinder whose combustion stroke had commenced 120 (°CA) before. The operation then proceeds to step 74 where the average speed data $\overline{N}$ showing the average engine speed at that time is calculated from the data $N_{in}$ obtained in step 73 and data $N_i(n-1)$ obtained prior to data $N_{in}$.

In the following steps 75 to 77, it is discriminated whether the coolant temperature $T_w$ is higher than a predetermined value $T_r$, whether the amount $A_p$ of depression of the accelerator pedal 11 is less than a predetermined value $A_1$, and whether the absolute value $|\overline{N}-N_t|$, which is the difference between the target idling rotational speed $N_t$ and the average idling rotational speed $\overline{N}$, has been below the value $K_1$ for longer than a predetermined period. Only when the results of the discrimination in all of the steps 75 through 77 are YES, does the operation move on to step 78 where the individual cylinder fuel quantity data $Q_{ATC}$ for individual cylinder control is calculated. On the other hand, if the result of the discrimination is NO in any of the steps 75 to 77, the operation moves to step 79 where the content of the data $Q_{ATC}$ is set to zero, so that no individual cylinder control is carried out.

After either step 78 or step 79 has been carried out, the operation moves to step 80 where data $Q_{ci}$ is calculated for controlling the average idling engine speed on the basis of the coolant temperature data $D_T$. After this, the procedure moves to step 81 where data $Q_t$ showing the amount of fuel injection required for each instant is calculated. The data $Q_t$ is equal to the total sum of data $Q_{DR}$, $Q_{ci}$ and $Q_{ATC}$. The value of $Q_{ATC}$ at this time is a value which was calculated at the time when the value of TDCTR was 8 units less than the present TDCTR value, that is, at the time 480 (°CA) earlier. In the next step 82, the data $Q_t$ is converted into control data D showing the position of the fuel regulating member 16 necessary for obtaining the amount of fuel injection shown by data $Q_t$ with reference to the average speed data $\overline{N}$. The operation then moves to step 83 where the control data D is output. Moreover, in the case where the result of the discrimination in step 72 is NO, steps 73 to 83 are not carried out. That is, as can be seen in FIG. 4, steps 73 to 83 are not carried out in response to the corresponding pulses of the top dead center pulse signal TDC produced at the maximum point of the instantaneous engine speed.

In this embodiment, the construction is arranged to carry out steps 78 to 83 during the period from the minimum point to the maximum point of the instantaneous engine speed N. However, it can also be arranged to carry out steps 78 to 83 during the period from the maximum point to the minimum point of the instantaneous engine speed N.

Figure 6:
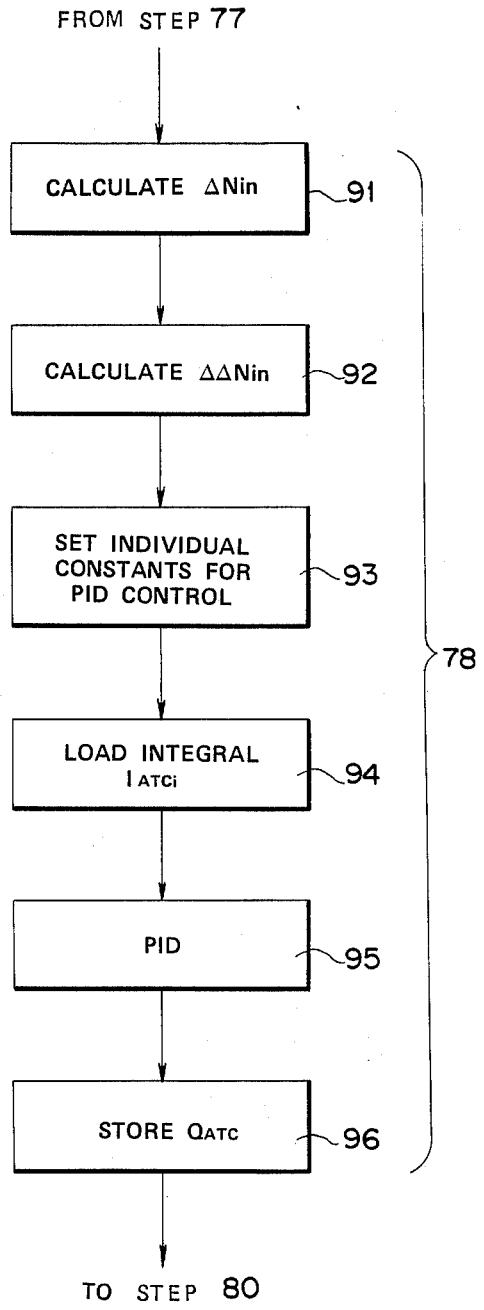
FIG. 6 is a detailed flowchart of a part of the flowchart shown in FIG. 5.

FIG. 6 shows a detailed flowchart of the calculation step 78 of $Q_{ATC}$ shown in FIG. 5. This detailed flowchart will be explained in the following. Firstly in step 91, the difference data $\Delta N_{in}$ is calculated, which shows the difference between data $N_{in}$ obtained in step 73 of this program cycle and data $N_{i(n-1)}$ obtained in step 73 of the previous program cycle. The procedure then moves on to step 92 where the difference $\Delta\Delta N_i$ between the difference data $\Delta N_{in}$ obtained in step 91 and the difference data $\Delta N_{i(n-1)}$ obtained in the same manner at a time one cycle before is calculated. After this, the operation moves to step 93 wherein the individual constants for PID control are set and then to step 94 where the integral term $I_{ATCi}$ is loaded. The procedure moves to step 95 where a PID control calculation is carried out and further to step 96 wherein the control data $Q_{ATC}$ for individual cylinder control obtained as a result of step 95 is stored in a RAM in relation to the TDCTR value at this time.

According to the above-mentioned control program, the content of the TDCTR reset by the occurrence of a lift pulse signal NLP is incremented every time a pulse of a top dead center pulse signal arises. Moreover, only when TDCTR is an odd number is calculation carried out for the instantaneous speed of rotation of the crankshaft according to the torque arising in each cylinder, resulting in individual cylinder control being carried out. Consequently, as already stated, data $N_{in}$ is calculated on the basis of the rotation of the crankshaft 4 during a predetermined measurement period determined so as to include that part of the period during which torque is produced due to fuel combustion in a specific cylinder during which no influence arises because of torque produced in cylinders other than the specific cylinder. As a result, it is possible to produce data relating to the output of each cylinder where influence from the output of other cylinders is suppressed to the minimum and also to carry out individual cylinder control of the idling operation with stability.

The present embodiment describes a case in which the present invention is applied to the idling operation control of a 4-cycle 6-cylinder type diesel engine. However, the present invention is not limited only to the construction of the present embodiment, but can also be applied to the idling operation control of a multi-cylinder internal combustion engine of a type other than the internal combustion engine represented in the embodiment.

According to the present invention, since the measuring period for obtaining data related to the output from each cylinder is set as forementioned, a comparatively accurate detection is possible of the output of each cylinder with the influence by the output from other cylinders being suppressed. Thus, it is possible to realize an accurate control of the amount of injection for every cylinder during the idling operation of the internal combustion engine and to carry out the idling operation with extreme stability.

I claim:

1. An apparatus for controlling the idling operation of an internal combustion engine having a closed-loop control system for controlling the amount of fuel to be supplied to a multi-cylinder internal combustion engine so as to maintain the average engine speed of the internal combustion engine at a desired target idling rotational speed, the output torque produced during the power stroke of a cylinder of said engine being influenced by the output torque of another cylinder, said apparatus comprising:

a first detecting means for detecting the operation timing of the internal combustion engine;

a second detecting means for producing a timing signal for determining a predetermined measurement period for each cylinder which includes that part of the combustion period during which torque is produced due to fuel combustion in a cylinder concerned during which no influence arises because of torque produced in cylinders other than the specific cylinder concerned, and only a portion of that part of the combustion period during which there is said influence because of torque produced in another cylinder such that said predetermined measurement period corresponds substantially to the minimum points of the instantaneous crankshaft speed associated with the specific cylinder concerned;

a first calculating means responsive to the timing signal for calculating and producing a first data related to the output from each cylinder of the internal combustion engine;

a second calculating means responsive to the first data for sequentially and repeatedly calculating and producing for every cylinder a difference data corresponding to the difference between the output from each cylinder and the output from a predetermined reference cylinder among the cylinders;

a third calculating means responsive to the difference data for calculating and producing an individual cylinder control data related to the supply of fuel necessary for reducing to zero the difference shown by the difference data;

an output control means for outputting the individual cylinder control data at a predetermined timing before the next fuel regulating process for the individual cylinders on the basis of the result of the detection in the first detecting means; and an adding means for supplying the individual cylinder control data to the closed-loop control system.

2. An apparatus as claimed in claim 1 wherein said first detecting means has a first signal generator for generating first pulses every time a crankshaft of said engine reaches predetermined reference angular positions, a second signal generator for generating second pulses every time fuel is injected into a predetermined cylinder of said engine, and a data output means responsive to said first and second pulses for producing discrimination data indicating which cylinder is in the combustion process.

3. An apparatus as claimed in claim 2 wherein said first signal generator generates the first pulse every time any of the pistons of said engine reaches its top dead center position.

4. An apparatus as claimed in claim 2 wherein said second signal generator is a lift sensor which is provided on a fuel injection nozzle mounted on the predetermined cylinder and produces the second pulses in response to the injecting operation of the fuel injection nozzle.

5. An apparatus as claimed in claim 2 wherein said data output means is a counting means which is reset in response to the second pulses and counts the number of input first pulses, and the result of the count is produced as the discrimination data.

6. An apparatus as claimed in claim 5 wherein said engine is a 4-cycle engine having more than four cylinders.

7. An apparatus as claimed in claim 6 wherein said second detecting means has a discriminator responsive to the discrimination data for discriminating whether or not the result of the count by said data output means is an odd number, and means responsive to the first pulses and the output of the discriminator for selectively outputting the first pulses in accordance with the result of the count of said data output means.

8. An apparatus as claimed in claim 1 wherein said first calculating means calculates data indicating the angular velocity of the crankshaft of said engine during the measurement period.

9. An apparatus as claimed in claim 8 wherein said second calculating means calculates the difference data in response to the first data in accordance with the difference between the angular velocity of the crankshaft of said engine for the cylinder concerned and that for the preceding cylinder.

10. An apparatus as claimed in claim 1 wherein said apparatus further comprises a switching means for controlling the supply of the individual cylinder control data to said adding means and the switching means is controlled in accordance with a condition of operation of said engine.

* * * * *